United States Patent [19]

Sakai et al.

[11] Patent Number: 4,737,090

[45] Date of Patent: Apr. 12, 1988

[54] MOVABLE VANE COMPRESSOR

[75] Inventors: Takuo Sakai, Kariya; Masato Yokoyama, Obu; Shinji Takeda, Nagoya; Eiichi Nagasaku; Makoto Kondo, both of Chiryu, all of Japan

[73] Assignee: Nippondenso Co., Ltd., Kariya, Japan

[21] Appl. No.: 868,680

[22] Filed: May 30, 1986

[30] Foreign Application Priority Data

May 30, 1985 [JP] Japan ..... 60-117167
Dec. 23, 1985 [JP] Japan ..... 60-290257

[51] Int. Cl.[4] ..... F04C 18/344
[52] U.S. Cl. ..... 418/150; 418/255
[58] Field of Search ..... 418/150, 253, 254, 255, 418/259

[56] References Cited

U.S. PATENT DOCUMENTS

| | | | |
|---|---|---|---|
| 1,046,791 | 12/1912 | Inhulsen | 418/255 |
| 1,922,951 | 8/1933 | Hawley | 418/257 |
| 1,952,834 | 3/1934 | Beidler et al. | 418/147 |
| 2,165,963 | 7/1939 | Curtis | 418/255 |
| 2,347,944 | 5/1944 | Fowler | 418/150 |
| 2,352,941 | 7/1944 | Curtis | 418/255 |
| 2,397,098 | 3/1946 | Fowler | 418/150 |
| 2,491,351 | 12/1949 | Zeitlin | 418/150 |
| 2,731,919 | 1/1956 | Prendergast | 418/28 |
| 4,373,880 | 2/1983 | Tanaka et al. | 418/150 |
| 4,419,059 | 12/1983 | Anderson | 418/255 |
| 4,484,873 | 11/1984 | Inagaki | 418/255 |
| 4,501,537 | 2/1985 | Ishizuka | 418/259 |
| 4,561,834 | 12/1985 | Poss | 418/255 |
| 4,616,984 | 10/1986 | Inagaki | 418/259 |

FOREIGN PATENT DOCUMENTS

| | | |
|---|---|---|
| 58-70086 | 4/1983 | Japan . |
| 58-106580 | 7/1983 | Japan . |

*Primary Examiner*—Carlton R. Croyle
*Assistant Examiner*—Jane E. Obee
*Attorney, Agent, or Firm*—Cushman, Darby & Cushman

[57] ABSTRACT

A movable vane compressor has a cylinder profile such as to reduce a pulsation of the driving torque for movable vane. This cylinder profile includes in series a region where the amount of vane projection increases; a region where the vane retracting speed increases; a region where the vane retracting speed decreases; a region where the vane retracting speed increases; a region where the vane retracting speed decreases; a region where the vane retracting speed increases; and a region where the vane retracting speed decreases.

9 Claims, 10 Drawing Sheets

MOVABLE VANE COMPRESSOR

FIELD OF THE INVENTION AND RELATED ART STATEMENT

The present invention relates to a movable vane compressor and more particularly to a movable vane compressor which has a cylinder profile such as to reduce a driving torque pulsation and which works effectively when incorporated in a car air conditioning system.

The conventional movable vane compressor of this kind includes a housing in which a cylinder bore is formed, a rotor eccentrically disposed in the cylinder bore, and sliding vanes slidingly movable in guide slots of the rotor. At the time of working, the rotor rotates with the vanes being in slidingly contact with the inner peripheral surface of the cylinder and then effects suction and compression of a refrigerant. Such a compressor causes vibration and noises when used in a car, since the driving torque largely varies during the compression stroke.

Various types of compressor have been carried out for the purpose of solving this problem. One of which is disclosed in Japanese Utility Model Unexamined Publication No. 106580/1983 involves a plurality of operating regions each defined by a cylinder bore and a rotor and partitioned by vanes, thereby shifting the phases of operations. Another is a type of changing the cylinder profile, as disclosed in Japanese Patent Unexamined Publication No. 70086/1983.

The first one requires a pularity of delivery openings and a plurality of delivery valves, so that the number of component parts is increased. According to the second one, the projecting acceleration change of the vane is so large that the vane cannot fully follow the inner surface of the cylinder. Moreover, the both can not sufficiently reduce the pulsation of the driving torque over a wide range of compression ratio. That is, it is not possible to reduce driving torque pulsations over a wide range of compression ratio relative to the fluctuations of the heat load of the cooler cycle and the compressor rotation frequency, etc. Thus, these conventional ones are disadvantageous.

OBJECT AND SUMMARY OF THE INVENTION

It is therefore an object of the present invention to provide a movable vane compressor with a small number of component parts, which is capable of reducing a driving torque pulsation with in an extremely small degree in a wide range of compression ratio and which is improved in ability of making the vanes follow the cylinder inner surface with being in contact therewith. To this end, the present invention provides an arrangement of the cylinder profile which in a direction of rotation of the rotor, successively includes regions as follows:

(a) a region where the amount of vane projection increases;
(b) a region where the vane retracting speed increases;
(c) a region where the vane retracting speed decreases;
(d) a region where the vane retracting speed increases;
(e) a region where the vane retracting speed decreases;
(f) a region where the vane retracting speed increases; and
(g) a region where the vane retracting speed decreases.

According to the present invention, it is possible to limit the fluctuation of the driving torque of the movable vane compressor to an extremely small extent over a wide range of compression ratio; reduce the number of component parts; and improve the ability of making the vane follow the cylinder inner surface with being in contact therewith.

DESCRIPTION OF THE PREFERRED EMBODIMENTS

The preferred embodiments of the present invention will be described hereinunder with reference to the accompanying drawings. In general, the compression ratio $\epsilon$ of a compressor may be estimated to be between 2 and 11 ($\epsilon \div 2 \sim 11$) during ordinary operation. The description will be made hereunder in relation to this range of compression ratio.

Figure 1:
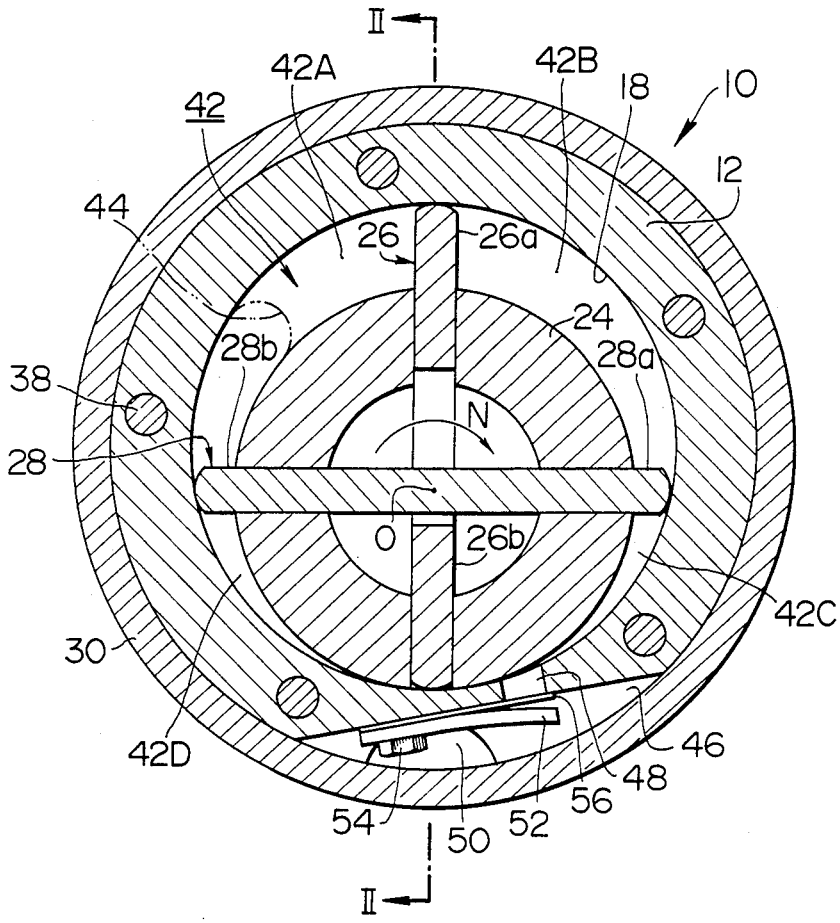
FIG. 1 is a transverse sectional view of a first embodiment of the present invention, taken along a line I—I of FIG. 2.
Figure 2:
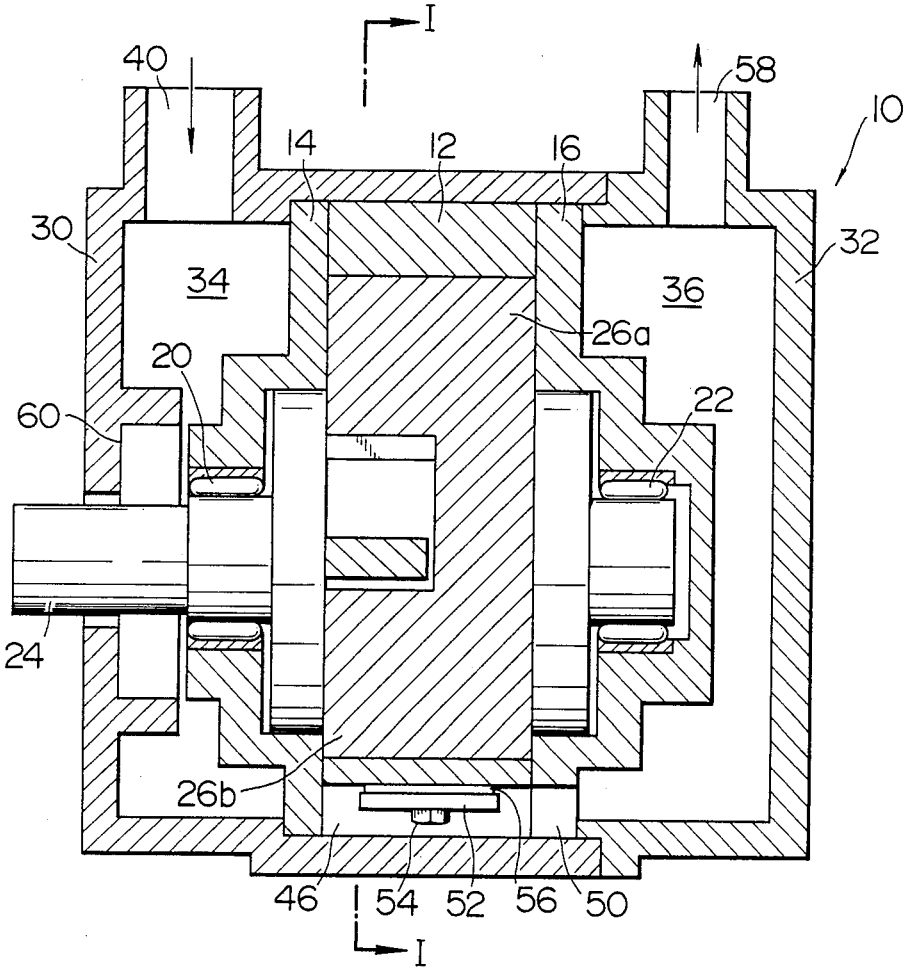
FIG. 2 is a longitudinal sectional view taken along a line II—II of FIG. 1.

FIGS. 1 and 2 are transverse and longitudinal sectional views of a movable vane compressor 10 according to a first embodiment of the present invention. A housing of the compressor 10 is defined by a cylinder 12 and a front end plate 14 and a rear end plate 16. The cylinder 12 is provided therein with a cylinder bore 18 having a cylinder bore profile which is later described with reference to FIG. 3. A rotor 24 is journaled at the front end plate 14 and the rear end plate 16 through antifriction bearings, e.g. needle roller bearings 20 and 22 such as to be rotatingly driven by a rotating force of a pulley or the like (not shown). As shown in FIG. 1, the center of rotation O of the rotor 24 is downwardly deviated from the center axis of the cylinder 12 such that the outer peripheral surface of the rotor 24 comes into contact with the cylinder bore 18 with a minute clearance provided therebetween. The rotor 24 is provided with two guide slots which diametrally extend through the center O of the rotor 24 and intersect with each other at right angles, and which extend over an entire axial length of the cylinder 12. Two vane members 26 and 28 are slidably and precisely fitted in these guide slots, which intersect with each other at right angles and have the same length.

Figure 15:
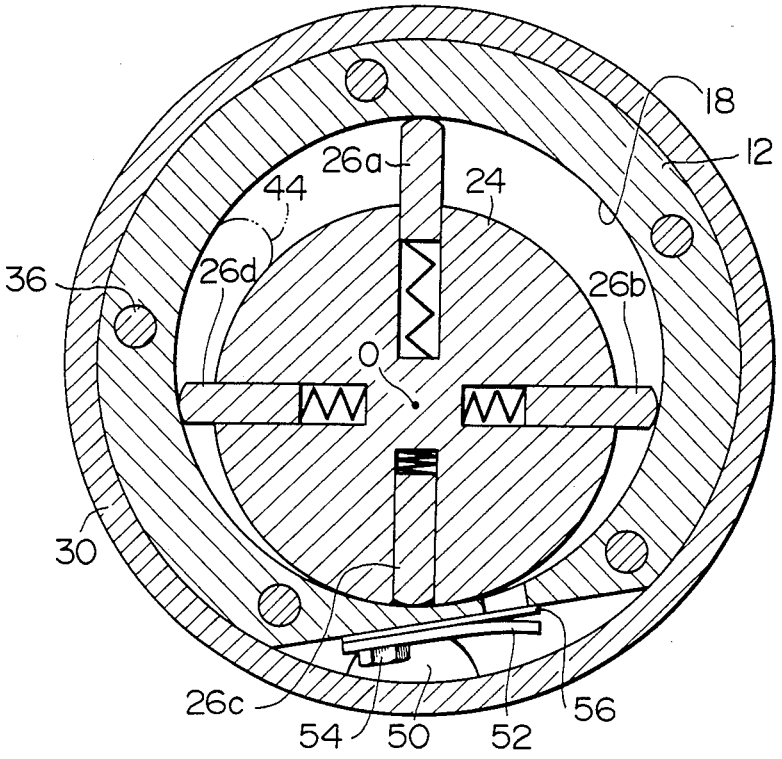
FIG. 15 is a transverse sectional view of a third embodiment according to the present invention.

In the movable vane compressor 10 shown in FIGS. 1 and 2, each vane members 26 and 28 has two vanes **26*a* and 26*b*, or 28*a* and 28*b* which are integrally interconnected to each other through a medium portion. As is apparent from FIG. 2, these vane members 26 and 28 pass through each other such as to be movable relative to each other through their central cut-out portions staggeredly formed. The movable vane compressor having such two vane members is called as "a through vane type". These vane members 26 and 28 provide four vanes 26*a*, 26*b*, 28*a* and 28*b*, and the cylinder profile is so defined that the sealing edges of all vanes simultaneously come into slidably contact with the inner peripheral surface of the cylinder. However, the present invention is not limited to the through vane type compressor, and is applicable to a movable vane compressor having four individual vanes 26*a*, 26*b*, 26*c* and 26*d*, as shown in FIG. 15**.

As shown in FIG. 2, a front cover 30 and a rear cover 32 are fitted onto the outer periphery of the housing, and form a suction chamber 34 and a delivery chamber 36 therebetween. The front cover 30, the front end plate 14, the cylinder 12, the rear end plate 16 and the rear cover 32 are integrally connected by means of five through bolts 38. The front cover 30 is provided with a suction opening 40 communicating with the suction chamber 34. The front end plate 14 is provided with a suction port 44 (FIG. 1) for the communication between the suction chamber 34 and a working chamber 42 of the compressor. The working chamber 42 is partitioned by the vane into four variable capacity working sub-chambers 42A–42D. The lower portion of the cylinder 12 is cut off, as shown in FIG. 1, and a valve chamber 46 is formed between the cut portion of the cylinder 12 and the front cover 30. The valve chamber 46 is communicated with the working chamber 42 through a delivery port 48 formed in the cylinder 12, and it is also communicated with the delivery chamber 36 through a delivery passage 50 formed in the rear end plate 16. The delivery port 48 is opened or closed by a delivery valve 56 attached to the cut portion of the cylinder 12 by means of a bolt 54 through a valve stopper 52. The rear cover 32 is provided with a delivery opening 58 communicating with the delivery chamber 36. The gap between the rotor and the front cover 30 is sealed by a shaft sealing means 60.

The operation of the movable vane compressor according to the first embodiment of the present invention will now described hereunder. When the rotor 24 is rotated by the driving force supplied from an engine or the like (not shown), each vane moves with being in contact with the inner peripheral surface of the cylinder 12 in a direction indicated by an arrow N in FIG. 1. At this time, a capacity of each working sub-chamber 42A–42D defined by the outer peripheral surface of the rotor 24, adjacent vane portions, the inner peripheral surface of the cylinder 12 and both inner surfaces of the end plates 14 and 16 is repeatingly increased and decreased. Therefore, a refrigerant is drawn into the working sub-chamber from an evaporator of a cooler unit (not shown) through the suction opening 40 of the front cover 30, the suction chamber 34, the suction port 44 formed in the front end plate 14. The refrigerant is compressed and pressurized and then fed through the delivery port 48, the valve chamber 46, the delivery passage 50, the delivery chamber 36 and the delivery opening 58 to a condenser of the cooler unit (not shown).

Figure 3:
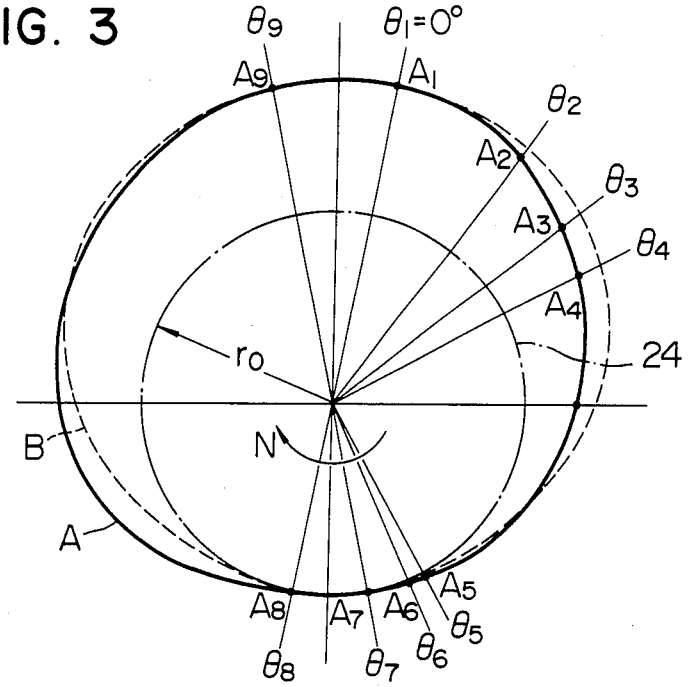
FIG. 3 is a diagram showing the cylinder profile.

Next, the profile of the cylinder bore will be described with reference to FIG. 3 in which cylinder profiles of this embodiment and of the conventional through vane type compressor are compared. A curve A indicated by the solid line in this drawing represents the cylinder profile of this embodiment. A curve B indicated by the dotted line represents a known cylinder profile of the conventional through vane type compressor. In order to make the sealing edges of all vanes constantly contact and slide on the inner peripheral surface of the cylinder, the curve B is set to satisfy the following formula (1);

$$d(\theta)=D/2\ (1+\cos\theta) \qquad (1)$$

where an angular position $\theta$ of rotation is to be 0°, at which the amount of vane projection d equals to a maximum value D, and $d(\theta)$ represents an amount of projection of vane at the angle $\theta$.

On the other hand, the cylinder profile of this embodiment or the curve A is composed of:

(1) a region $A_7A_8$ where the outer peripheral surface of the rotor is in contact with the inner peripheral surface of the cylinder;
(2) a region $A_8A_9$ where the amount of vane projection increases;
(3) a region $A_9A_1$ where the amount of vane projection is maximum and constant;
(4) a region $A_1A_2$ where the vane retracting speed increases;
(5) a region $A_2A_3$ where the vane retracting speed decreases;
(6) a region $A_3A_4$ where the vane retracting speed increases;
(7) a region $A_4A_5$ where the vane retracting speed decreases;
(8) a region $A_5A_6$ where the vane retracting speed increases; and
(9) a region $A_6A_7$ where the vane retracting speed decreases.

These regions are defined by a curve which continues highly smoothly.

The region $A_7A_8$ is provided for the purpose of sealing between the rotor 24 and the cylinder, and it may be omitted. The region $A_9A_1$ is necessary only when the sealing portion of the region $A_7A_8$ is provided in the through vane type compressor, and it may be also omitted.

The principle of supressing the driving torque pulsation according to the present invention will now be described.

In the movable vane compressor, the driving torque t $(\theta)$ effecting one vane is determined by a pressure difference $\Delta P$ $(\theta)$ affecting the one vane, an amount of vane projection d $(\theta)$, a longitudinal length l of the working chamber and a rotor radius $r_o$, and it is represented in relation to the rotation angle $\theta$ by the following formula (2):

$$t(\theta)=l\cdot\Delta P(\theta)\cdot d(\theta)\ (r_o+d(\theta)/2) \quad (2)$$

Let a capacity of the working sub-chamber positioned in front of the vane be V ($\theta$) and a pressure thereof be P ($\theta$). The following formula (3) and (4) are established by using a maximum capacity Vs, a suction pressure Ps and a delivery pressure Pd.

$$P(\theta)=Ps\ (Vs/V(\theta))^K \quad (3)$$

(when $P(\theta)>Pd,\ P(\theta)=Pd$)

where K represents an adiabatic index which is 1.14 in a refrigerant fleon 12 generally used in car compressors.

Then, $$\Delta P(\theta)=P(\theta)-P(\theta-90°) \quad (4)$$

The total driving torque T of the movable vane compressor is represented as the sum of the driving torques each obtained from the formula (2):

$$T=t(\theta)+(\theta+90°)+t(\theta+180°)+t(\theta+270°) \quad (5)$$

Since the sliding point between the rotor 24 and the cylinder 18 is angularly separated from the end of the suction port 44 by a rotation angle of more than 90°, each level of pressure applied to the front and the rear of at least one of the four vanes is equal to the suction pressure Ps, that is, $P(\theta)=P(\theta-90°)=Ps$ from the formula (4). Accordingly, it is substantially possible to represent the total driving torque T by the sum of driving torques effecting the remaining three vanes as follows.

$$T=t_1+t_2+t_3 \quad (6)$$

where $t_1$ represents a driving torque applied to a vane which advances by 90° from a vane to which a driving torque $t_2$ is applied in the direction of the rotation of the rotor and $t_3$ represents a driving torque applied to a vane which retards by 90° from the vane to which the driving torque $t_2$ is applied.

Figure 4A:
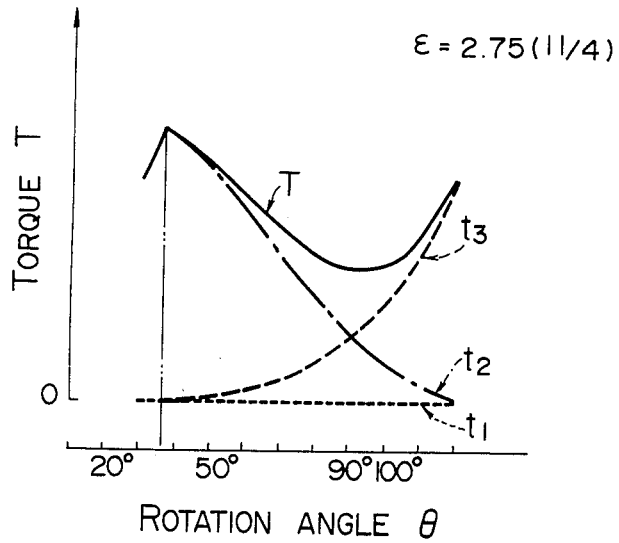
FIGS. 4A, 4B and 4C are graphs showing the relationship between the driving torque and the rotation angle in an example according to the conventional compressor.
Figure 4B:
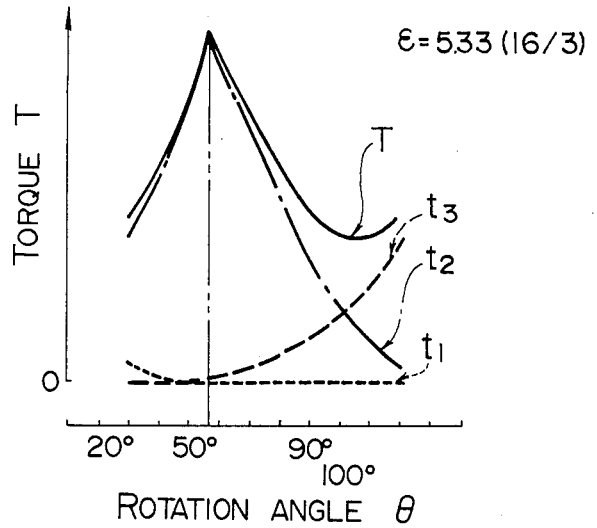
Figure 4C:
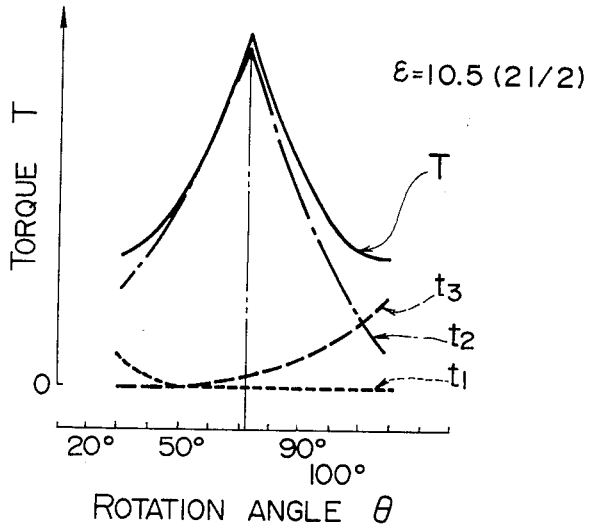

FIGS. 4A, 4B and 4C show the total driving torque T and the driving torques $t_1-t_3$ at each of compression ratios $\epsilon=2.75$, 5.33, 10.5 ($\epsilon=Pd/Ps$) of the known cylinder profile of the conventional through vane type compressor obtained from the formulae (2) to (6).

As shown in these drawings, the driving torque which is applied to a vane portion located at a rotation angle from 20° to 90° is most dominative over the driving torque pulsation. Accordingly, it is possible to minimize the pulsation of the driving torque over a wide range of compression ratio, that is, a wide range of rotation frequencies, by controlling the configuration of the cylinder profile at this area through the following procedures.

(1) In the region $A_1A_2$ where the driving torque applied to a vane generally rises abruptly, the vane portion retracting speed is abruptly increased. In this region, a peak of the driving torque at a lower compression ratio is mainly reduced.

The vane retracting speed V($\theta$) is represented as follows.

$$V(\theta)=a(\theta-\theta_1)\ (a>0)$$

(2) In the region $A_2A_4$, the vane retracting speed V($\theta$) is maintained at constant and maximum (Vmax) in order to reduce an acute peak which may be appeared at a medium to a high compression ratios.

The vane retracting speed V($\theta$) is as follows.

$$V(\theta)=\text{const.}=Vmax$$

(3) In the region $A_4A_5$, the vane retracting speed is gradually decreased. In the first half of this region, a peak in a range of high compression ratio is mainly reduced. In the second half of this region, a bottom of the torque wave form (in the vicinity of the level of $t_1$ at a rotation angle of 20° in FIGS. 4A, 4B and 4C) is heightened so as to smooth the level of the total driving torque.

The vane retracting speed V($\theta$) is as follows.

$$V(\theta)=b(\theta-\theta_4)+Vmax\ (<0)$$

(4) In the region $A_5A_6$, the vane retracting speed is constantly maintained at a relatively lower level Vc.

$$V(\theta)=\text{const.}=Vc.$$

In this region, a driving torque which is indicated by $t_3$ in FIGS. 4A, 4B and 4C has been applied to a vane oppositely located at 180° relative to this region starts to rise slowly. The rising rate is heightened in order to smooth the level of the total driving torque T. In the through vane compressor, the vane retracting speed is maintained at constant in the region of $A_5A_6$ mechanism such as to assist, so that the vane located oppositely by 180° is encouraged to increase the amount of projection thereof, thus heightening the rising speed of $t_3$. There is no problem when the vane retracting speed is maintained constantly, since in this region $A_5A_6$, both levels of pressure applied to the front and the rear of the vane are equal to the deliverly pressure Pd even in compressors other than the through vane type.

(5) In the region $A_6A_7$, the vane retracting speed is abruptly decreased such as to smoothly connect this region to a perfect arc portion $A_7A_8$.

The vane retracting speed V($\theta$) is as follows.

$$V(\theta)=C\ (\theta-\theta_6)+Vc\ (C<0).$$

Figure 5:
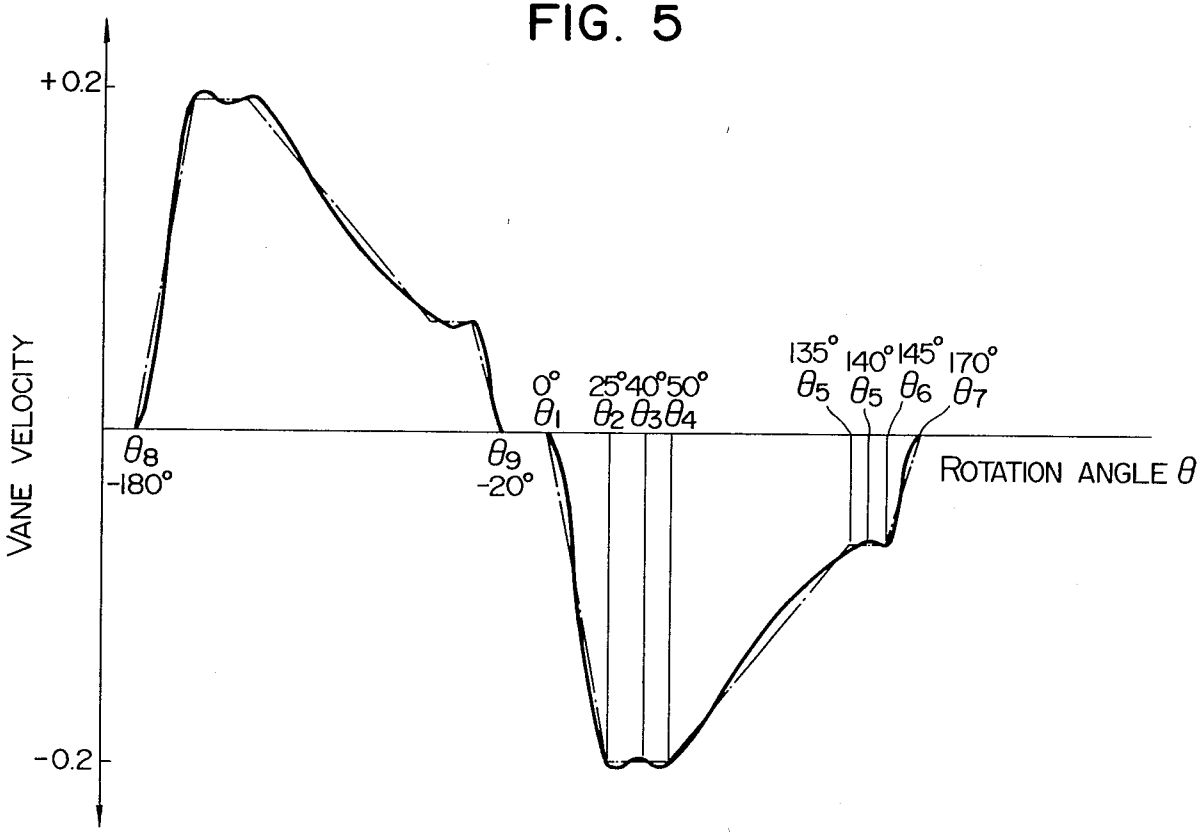
FIG. 5 is a graph showing the projecting speed and the retracting speed of a vane in the first embodiment.

In FIG. 5, the chain line indicates an ideal vane retracting speed obtained from the above formulae (1) to (5) and also indicates the vane projecting speed which is definitely out of phase by 180° in the case of the through vane compressor. In order to make the vane retracting speed close to the ideal one and to provide a cylinder profile having a smooth configuration in terms of appearance and workability, the solid line in FIG. 5 is employed as the vane retracting speed. The cylinder profile is determined on the basis of this vane retracting speed. It is formed by a smoothly continuous closed curve such as to define:

(1) a region $A_7A_8$ where the outer peripheral surface of the rotor is in contact with the inner peripheral surface of the cylinder;

(2) a region $A_8A_9$ where the amount of vane projection increases;

(3) a region $A_9A_1$ where the amount of vane projection is maximum and constant;

(4) a region $A_1A_2$ where the vane retracting speed increases;
(5) a region $A_2A_3$ where the vane retracting speed decreases;
(6) a region $A_3A_4$ where the vane retracting speed increases;
(7) a region $A_4A_5$ where the vane retracting speed decreases;
(8) a region $A_5A_6$ where the vane retracting speed increases; and
(9) a region $A_6A_7$ where the vane retracting speed decreases.

By using this cylinder profile, it is possible to reduce the driving torque pulsation to an extremely small degree over a wide range of compression ratio. In this embodiment, the starting point $A_1$ of the region $A_1A_2$ is at $\theta=0°$, a transition point $A_2$ between the regions $A_1A_2$ and $A_2A_3$ is positioned at a rotation angle of about $\theta=25°$; a transition point $A_3$ between the regions $A_2A_3$ and $A_3A_4$ is at about $\theta=40°$; a transition point $A_4$ between the regions $A_3A_4$ and $A_4A_5$ is at about $\theta=50°$; a transition point $A_5$ between the regions $A_4A_5$ and $A_5A_6$ is at about $\theta=140°$; and a transition point $A_6$ between the regions $A_5A_6$ and $A_6A_7$ is at about $\theta=145°$.

Figure 6:
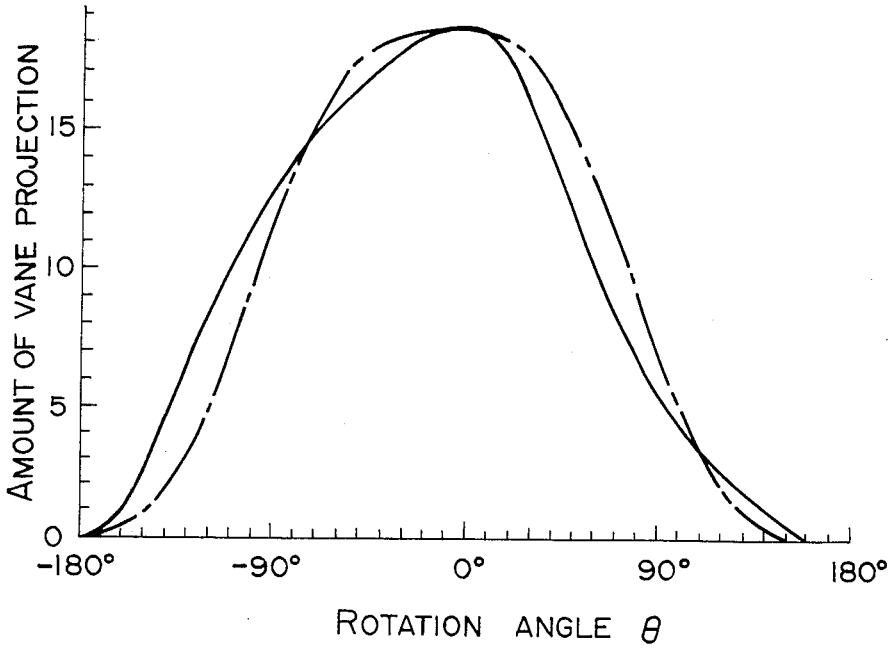
FIG. 6 is a graph showing the amount of projection of the vane in the first embodiment.

In FIG. 6, the solid line shows the relationship between the amount of vane projection and the rotation angle $\theta$ determined by the vane projecting speed and the vane retracting speed indicated by the solid line in FIG. 5. In this drawing, the broken line indicates the amount of vane projection in accordance with the known profile of the conventional movable vane compressor.

Figure 7:
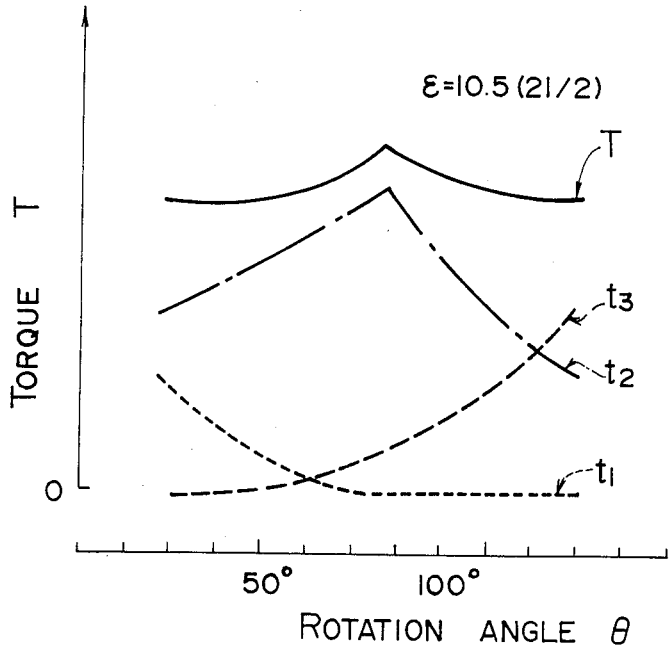
FIG. 7 is a graph showing the relationship between the driving torque and the rotation angle in the first embodiment.

FIG. 7 shows each driving torque $t_1$, $t_2$ and $t_3$ applied to each vane at a compression ratio $\epsilon=10.5$ and shows the total driving torque T in the movable vane compressor of this embodiment.

Figure 8:
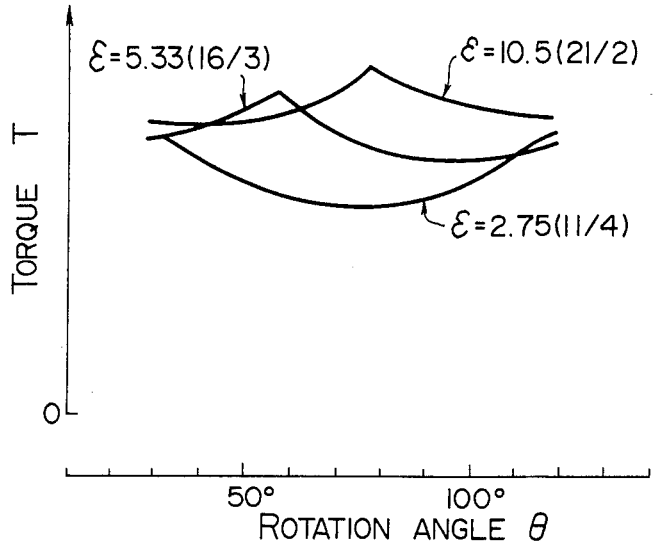
FIG. 8 is a graph showing the driving torque of the first embodiment in relation to different compression ratios.

FIG. 8 is a graph showing the fluctuation of the total driving torque T in relation to the rotation angle $\theta$ at different compression ratios in the movable vane compressor.

Figure 9:
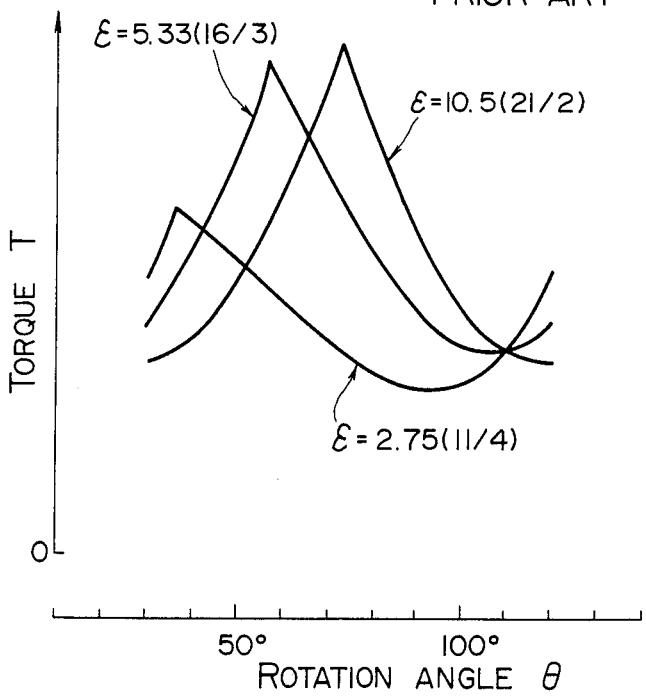
FIG. 9 PRIOR ART
FIG. 9 is a graph showing the driving torque of the conventional compressor in relation to different compression ratios.

FIG. 9 is a graph showing the fluctuation of the total driving torque T in the conventional movable vane compressor.

In this embodiment, as shown in FIG. 1, the rotor 24 is provided with two guide slots which diametrally pass through the center of the rotor 24 and intersect with each other at right angle and which extend over the entire length of the cylinder 12. Two vane members 26 and 28 are slidably and precisely fitted in these guide slots, which intersect with each other at right angle and have the same length. This arrangement may be altered such as shown in FIG. 10.

Figure 10:
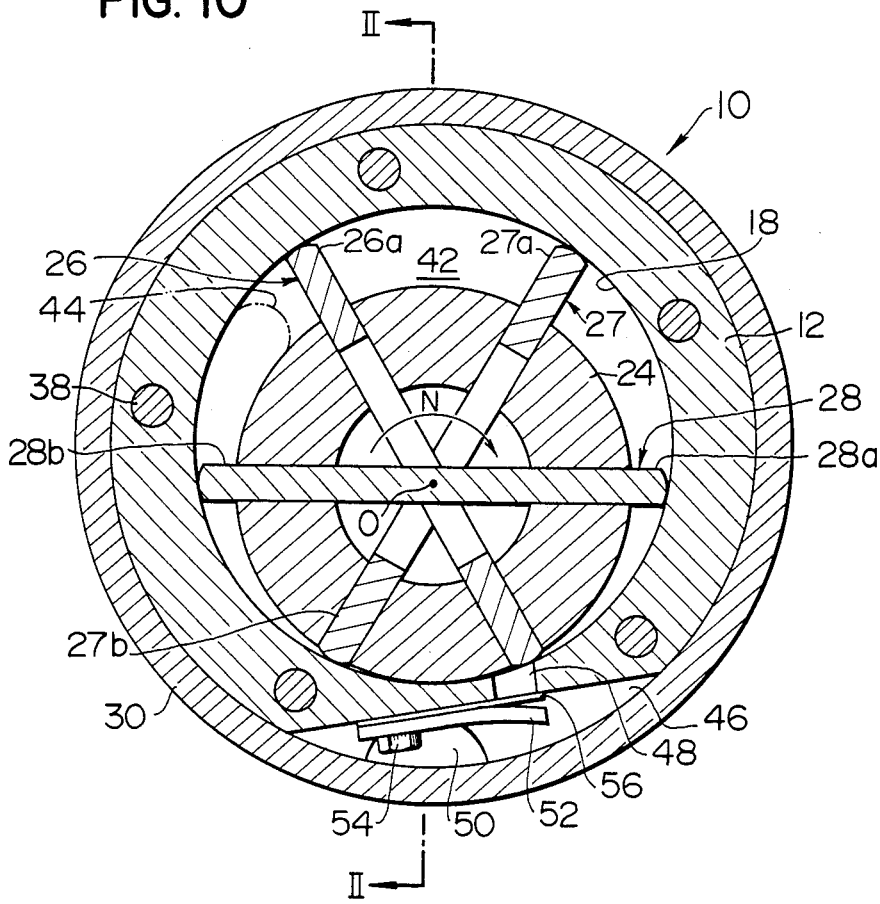
FIG. 10 is a transverse sectional view of a second embodiment according to the present invention.

As shown in FIG. 10, the rotor 24 is provided with three guide slots which diametrally pass through the centre O of the rotor 24 and are equiangularly disposed at interval of 60° and which extend over the entire longitudinal length of the cylinder 12. Three vane members 26, 27 and 28 having the same length are slidably and precisely fitted in these guide slots.

Figure 11A:
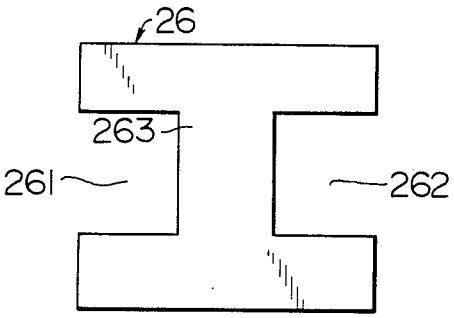
FIG. 11A is a front view of a vane member 26 of the second embodiment.
Figure 11B:
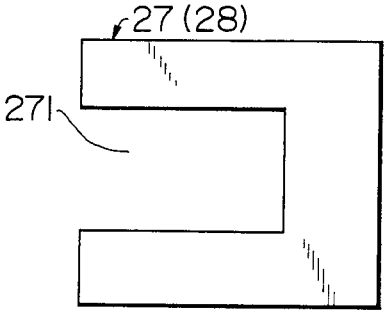
FIG. 11B is a front view of vane member 27 or 28 of the second embodiment.
Figure 12:
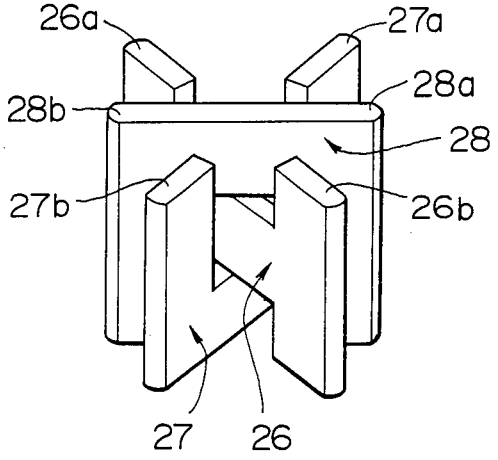
FIG. 12 is a perspective view showing a construction of the vane in the second embodiment.

In the movable vane compressor 10 shown in FIG. 10, each vane member 26, 27 and 28 has two vanes **26*a*, 26*b*, 27*a* and 27*b*, or 28*a* and 28*b* which are integrally interconnected to a medium portion. As shown in FIG. 11A, the vane member 26 presents a H-shaped form which includes cut-out portions 261 and 262, and each of the vane members 27 and 28 presents, as shown in FIG. 11B, a U-shaped form which includes a cut-out portion 271. These vane members are arranged such that, as shown in FIG. 12, the vane members 27 and 28 are inserted from the opposite directions to the medium portion of the vane member 26 so that the cut-out portions 261 and 262 of the vane member 26 receive the medium portions of the vane members 27 and 28**.

Thus, six vanes **26*a*, 26*b*, 27*a*, 27*b*, 28*a* and 28*b* are provided in the vane assembly by three vane members 26, 27 and 28**.

In this arrangement, the total driving torque T of the movable vane compressor is the sum of the driving torques each obtained from the formula (2) with respect to the six vanes:

$$T=t(\theta)+(\theta+60°)+t(\theta+120°)+t(\theta+180°)+t(\theta+240°)+t(\theta+300°). \quad (7)$$

The pressure difference $\Delta P(\theta)$ between levels of pressures applied to the front and the rear of a vane is represented by the following formula (8).

$$P(\theta)=P(\theta)-P(\theta-60°) \quad (8)$$

Since the sliding contact point between the rotor 24 and the cylinder 12 is angularly separated from the end of the suction port 44 by a rotation angle of more than 120°, each level of pressure applied to the front and the rear of at least two of the six vanes is represented by $\Delta P(\theta)=P(\theta-60°)=P(\theta-120°)$. Accordingly, it is substantially possible to represent the total driving torque T' by the sum of driving torques effecting the remaining four vanes as follows.

$$T'=t_1'+t_2'+t_3'+t_4'. \quad (9)$$

where $t_1'$ represents a driving torque applied to a vane which advances by 60° from a vane to which a driving torque $t_2'$ in the direction of the rotor rotation, $t_3'$ represents a driving torque applied to a vane which retards by 60° from the vane to which the driving torque $t_2'$ is applied; and $t_4'$ represents a driving torque applied to a vane which retards by 60° from the vane to which the driving torque $t_3'$ is applied.

Figure 13:
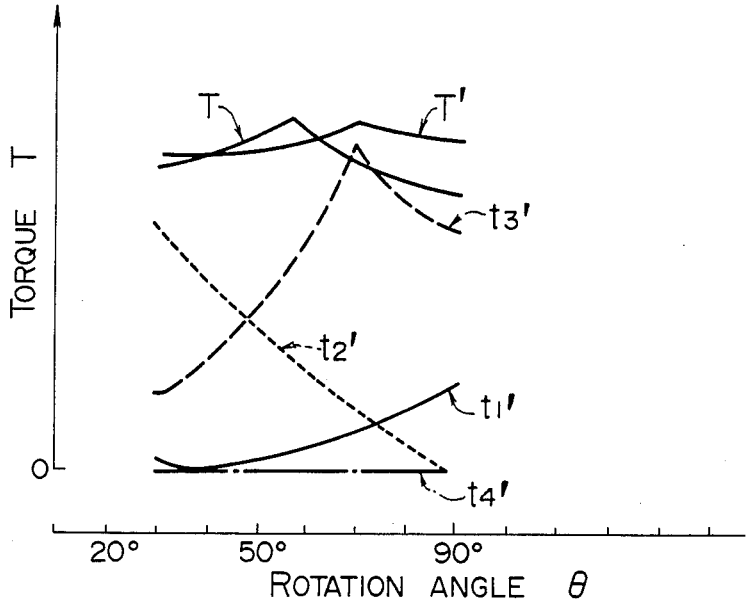
FIG. 13 is a graph showing the relationship between the driving torque and the rotation angle in the second embodiment.

FIG. 13 shows each driving torque $t_1$, $t_2$, $t_3$ and $t_4$ applied per vane at a compression ratio $\epsilon=5.33$ and shows the total driving torque T'. As is apparent from FIG. 13, the pulsation of the total driving torque T' thereby obtained is further lowered compared with that of the torque T supplied by the compressor having four vanes.

Figure 14:
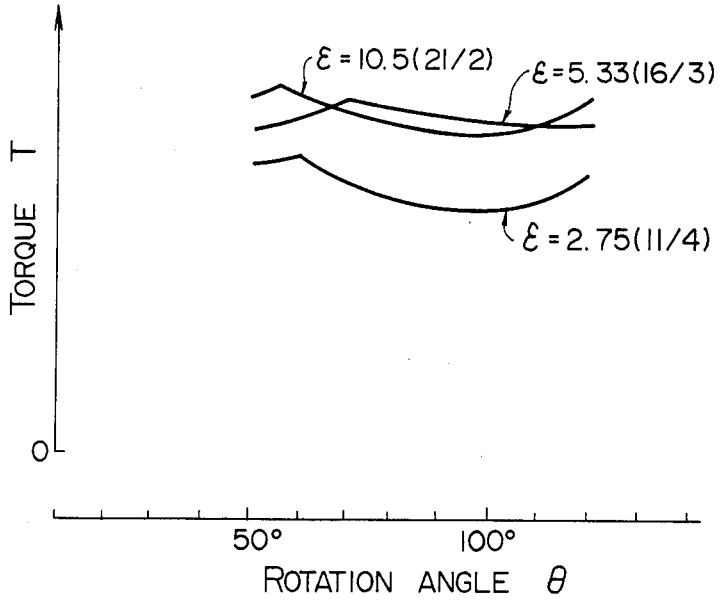
FIG. 14 is a graph showing the driving torque of the second embodiment in relation to different compression ratios.

As is apparent from FIG. 14 which is a graph showing the fluctuations of the total driving torque T, the pulsation of the total driving torque is extremely small even when the compression ratio is changed.

What is claimed is:

1. A through vane type compressor comprising:

a housing including an inner peripheral surface defining a cylinder bore having a closed profile which comprises the following regions in series:

(a) a region where an amount of vane projection increases;
(b) a region where a vane retracting speed increases;
(c) a region where a vane retracting speed decreases;
(d) a region where a vane retracting speed increases;
(e) a region where a vane retracting speed decreases;

(f) a region where a vane retracting speed increases; and (g) a region where a vane retracting speed decreases;

a rotor eccentrically disposed in said cylinder bore, said rotor having an outer peripheral surface in contact with a part of the inner peripheral surface of said housing with a minute clearance therebetween;

even-numbered recesses provided in said rotor, said recesses being equiangularly spaced from each other and extending from the outer peripheral surface of said rotor towards a rotational center thereof; and sliding vane members each forming two sliding vanes disposed in said recesses for reciprocating therein, each of which is in fluid tight contact with said inner peripheral surface of said housing and is provided at a center portion thereof with a cut-out portion through which said vane members are movable relative to each other in said rotor.

2. A compressor according to claim 1, wherein, when the starting point of said region (b) is to be at a rotation angle $\theta=0°$, a transition point between said regions (b) and (c) is positioned at a rotation angle of about $\theta=25°$; a transition point between said regions (c) and (d) is at about $\theta=40°$; a transition point between said regions (d) and (e) is at about $\theta=50°$; a transition point between said regions (e) and (f) is at about $\theta=140°$; and a transition point between said regions (f) and (g) is at about $\theta=145°$.

3. A movable vane compressor according to claim 1, wherein said closed profile of said housing further includes a region where an amount of vane projection is maximum and constant.

4. A compressor according to claim 1, wherein the number of said sliding vanes is six.

5. A compressor according to claim 4, wherein each pair of said recesses diametrally opposing each other are communicated with each other.

6. A compressor according to claim 5, wherein said six vanes are formed by three vane members, one of said vane members having opposite cut-out portions and presenting a H-shaped form and each of remaining two vane members of said vane members having a cut-out portion and presenting a U-shaped form.

7. A compressor according to claim 1, wherein the number of said sliding vanes is four.

8. A compressor according to claim 7, wherein each pair of said recesses diametrally opposing each other are communicated with each other.

9. A compressor according to claim 8, wherein said four vanes are formed by two vane members each having a U-shaped cut-out portion.

* * * * *